US007330533B2

(12) United States Patent
Sampayon

(10) Patent No.: US 7,330,533 B2
(45) Date of Patent: Feb. 12, 2008

(54) COMPACT X-RAY SOURCE AND PANEL

(75) Inventor: Stephen E. Sampayon, Manteca, CA (US)

(73) Assignee: Lawrence Livermore National Security, LLC, Livermore, CA (US)

( * ) Notice: Subject to any disclaimer, the term of this patent is extended or adjusted under 35 U.S.C. 154(b) by 187 days.

(21) Appl. No.: 11/124,550

(22) Filed: May 5, 2005

(65) Prior Publication Data

US 2006/0056595 A1 Mar. 16, 2006

(51) Int. Cl.
*H01J 35/00* (2006.01)

(52) U.S. Cl. ..... 378/119; 378/137; 378/138

(58) Field of Classification Search ..... 378/119, 378/122, 124, 136, 137, 138
See application file for complete search history.

(56) References Cited

U.S. PATENT DOCUMENTS

| | | | | |
|---|---|---|---|---|
| 5,508,590 | A | 4/1996 | Sampayan et al. | 315/169.1 |
| 5,723,954 | A | 3/1998 | Sampayan | 315/326 |
| 6,045,678 | A | 4/2000 | Morse et al. | 205/123 |
| 6,259,765 | B1 * | 7/2001 | Baptist | 378/136 |
| 6,331,194 | B1 | 12/2001 | Sampayan et al. | 29/25.03 |
| 6,628,745 | B1 | 9/2003 | Annis et al. | 378/21 |
| 6,807,248 | B2 | 10/2004 | Mihara et al. | 378/10 |
| 7,130,379 | B2 * | 10/2006 | Hamann et al. | 378/119 |
| 2002/0094064 | A1 * | 7/2002 | Zhou et al. | 378/122 |
| 2004/0096035 | A1 * | 5/2004 | Yamazaki et al. | 378/97 |

OTHER PUBLICATIONS

Keiichi Hori, "Development of Ultra-Fast X-Ray Computed Tomography Scanner System", Transactions on Nuclear Science vol. 45, No. 4 Aug. 1998 pp. 2089-2094.
Keiichi Hori, "Application of Cadmium Telluride Detector to High Speed X-Ray CT Scanner", Nuclear Instruments and Methods in Physics Research, Sec A 380 (1996) pp. 397-401.

* cited by examiner

*Primary Examiner*—Courtney Thomas
(74) *Attorney, Agent, or Firm*—James S. Tak; John H. Lee

(57) ABSTRACT

A compact, self-contained x-ray source, and a compact x-ray source panel having a plurality of such x-ray sources arranged in a preferably broad-area pixelized array. Each x-ray source includes an electron source for producing an electron beam, an x-ray conversion target, and a multilayer insulator separating the electron source and the x-ray conversion target from each other. The multi-layer insulator preferably has a cylindrical configuration with a plurality of alternating insulator and conductor layers surrounding an acceleration channel leading from the electron source to the x-ray conversion target. A power source is connected to each x-ray source of the array to produce an accelerating gradient between the electron source and x-ray conversion target in any one or more of the x-ray sources independent of other x-ray sources in the array, so as to accelerate an electron beam towards the x-ray conversion target. The multilayer insulator enables relatively short separation distances between the electron source and the x-ray conversion target so that a thin panel is possible for compactness. This is due to the ability of the plurality of alternating insulator and conductor layers of the multilayer insulators to resist surface flashover when sufficiently high acceleration energies necessary for x-ray generation are supplied by the power source to the x-ray sources.

19 Claims, 6 Drawing Sheets

COMPACT X-RAY SOURCE AND PANEL

The United States Government has rights in this invention pursuant to Contract No. W-7405-ENG-48 between the United States Department of Energy and the University of California for the operation of Lawrence Livermore National Laboratory.

I. FIELD OF THE INVENTION

The present invention relates to x-ray generating systems, and more particularly to a compact x-ray source having a substantially minimized drift distance, and a thin broad-area x-ray source panel comprising a plurality array of such compact x-ray sources.

II. BACKGROUND OF THE INVENTION

Broad beam x-ray sources, such as shown in FIG. 1 at reference character 10, are commonly known, and typically utilize a scanning technique of a highly collimated electron beam to develop a line or raster scanned pattern. In particular, these broad beam X-ray sources include a hot filament cathode 11 to produce electrons, and a positively-charged anode 16, i.e. an x-ray conversion target such as tungsten, spaced from the cathode to draw and accelerate the electrons to a specified energy. Between the anode and cathode are focusing and auxiliary electrodes 12 to focus the electrons into an electron beam 14, and deflection plates 13, e.g. electrostatic or magnetic deflection plates, to scan the electron beam 14 across the X-ray conversion target 16 as indicated by arrow 15 and generate x-rays from the various scanned locations/points of the target. The x-rays generated in this manner can be directed at a subject 17, e.g. a patient or object, and detected with a suitable detector 18 for imaging the subject. One example of such an x-ray imaging system using electron beam scanning is shown in U.S. Pat. No. 6,628,745. Other methods may use mechanical means to move the x-ray source relative to a detector and object so as to also generate x-rays from spatially-differentiated locations. In any case, such methods are often used, for example, in CT scans of luggage, cargo containers and the like for security and commercial inspection purposes, as well as for use in medical diagnostic applications.

The problem, however, with the scanning technique utilized in current broad-beam x-ray sources is the large and bulky size typically associated with such systems due to the geometry of the scanning arrangement. Scanning over a large area x-ray conversion target requires that the electron beam undergo a drift (i.e. separation distance between cathode and anode) comparable to the longest dimension of the area to be scanned in order to reach the outer extremities of the target. Due to this geometric limitation, the dimensions of the vacuum envelope of the x-ray source (spanning between the hot filament to target) consumes a significant portion of the overall system size, making the system large, cumbersome, and usually very expensive. Because designers cannot easily anticipate the wide variety of objects a user would seek to image, and the expense of such large-scale/dimensioned systems is so significant, a "one size fits all" mentality is incorporated into the design and acquisition of very large aperture x-ray imaging systems, with the net result being a narrowed use of the technology only by larger institutions.

What is needed therefore is a compact, scalable, and relatively inexpensive x-ray source that can be used in a broad range of settings and for imaging a wide variety of target subjects/shapes. Furthermore, what is needed is a compact x-ray source panel having a simple basic construction which is scalable and enables complex panel shapes to be realized for adaptably conforming to a subject to be imaged. Such an x-ray source and imaging system would be particularly useful, for example, in emergency medical response situations by targeting and imaging only specific areas, e.g. a patient's traumatized head, to provide rapid diagnosis of the injury and implement the appropriate emergency procedure.

III. SUMMARY OF THE INVENTION

The present invention is generally directed to a compact x-ray source having an electron source, an x-ray conversion target, and a multilayer insulator separating the electron source a short distance away from the x-ray conversion target to establish a short drift distance/spacing therebetween. Short separation distances between a cathode and anode can produce surface flashovers in insulators when high voltage energies are applied therebetween, especially at the high voltages necessary for x-ray production, e.g. 150 kV. The multilayer insulator used in the present invention is of a type similar to that disclosed in U.S. Pat. No. 6,331,194, designed to inhibit such surface flashover between the closely spaced electrodes and thereby enable large differences in potential to be applied therebetweeen (typically over 100 kV/cm). In this manner, the use of the multilayer insulator enables the substantial reduction of the scale size of a unit x-ray source into an extremely compact structure which may be 10 to 100 times less the volume of existing technology, with an attendant reduction in cost. Similarly, a plurality of such unit x-ray sources arranged as a broad-area array of an x-ray source panel can also realize substantial reduction in size in that the panel depth is substantially smaller/thinner than it is tall or wide.

One aspect of the present invention includes a compact x-ray source panel comprising: an array of x-ray sources, each x-ray source comprising: an electron source; an x-ray conversion target capable of generating x-rays when incidenced by electrons; and a multilayer insulator having a plurality of alternating insulator and conductor layers separating the electron source from the x-ray conversion target; and a power source operably connected to each x-ray source of the array to produce an accelerating gradient between the electron source and the x-ray conversion target in any one or more of the x-ray sources, for accelerating electrons to toward a corresponding x-ray conversion target.

Another aspect of the present invention includes a compact x-ray source comprising: an electron source; an x-ray conversion target; a multilayer insulator comprising a plurality of alternating insulator and conductor layers which separate the electron source from the x-ray conversion target; and a power source operably connected to the electron source and the x-ray conversion target to produce an accelerating gradient therebetween, for accelerating electrons toward the x-ray conversion target.

And another aspect of the present invention includes a compact x-ray source panel comprising: a broad-area array of independently controllable x-ray source pixels, each x-ray source pixel comprising: an electron source for producing electrons; an x-ray conversion target capable of generating x-rays when incidenced by electrons; and a cylindrical multilayer insulator having a plurality of alternating insulator and conductor ring-shaped layers separating the electron source from the x-ray conversion target, and an evacuated acceleration channel communicating therebeween; and a power source operably connected to each x-ray source pixel of the broad-area array to produce an accelerating gradient in the acceleration channel of any one or more of the x-ray source pixels, for accelerating electrons through the acceleration channel towards a corresponding x-ray conversion target, wherein the plurality of alternating insulator and conductive layers of the multilayer insulators enable a high resistance to surface flashover in the energy range necessary to produce a sufficiently high accelerating gradient for generating x-rays and with the electron source and x-ray conversion target in close proximity to each other.

And another aspect of the present invention includes an x-ray imaging system comprising: a compact x-ray source panel comprising an array of x-ray sources, each x-ray source comprising: an electron source; and an x-ray conversion target capable of generating x-rays when incidenced by electrons; and an insulator separating the electron source from the x-ray conversion target; a power source operably connected to each x-ray source of the array to produce an accelerating gradient between the electron source and the x-ray conversion target in any one or more of the x-ray sources, for accelerating electrons toward a corresponding x-ray conversion target; a detector capable of detecting x-rays generated by said compact x-ray source panel; and a controller operably connected to receive signals from the detector and control the compact x-ray source panel based upon said signals.

IV. BRIEF DESCRIPTION OF THE DRAWINGS

The accompanying drawings, which are incorporated into and form a part of the disclosure, are as follows.

V. DETAILED DESCRIPTION

Figure 1:
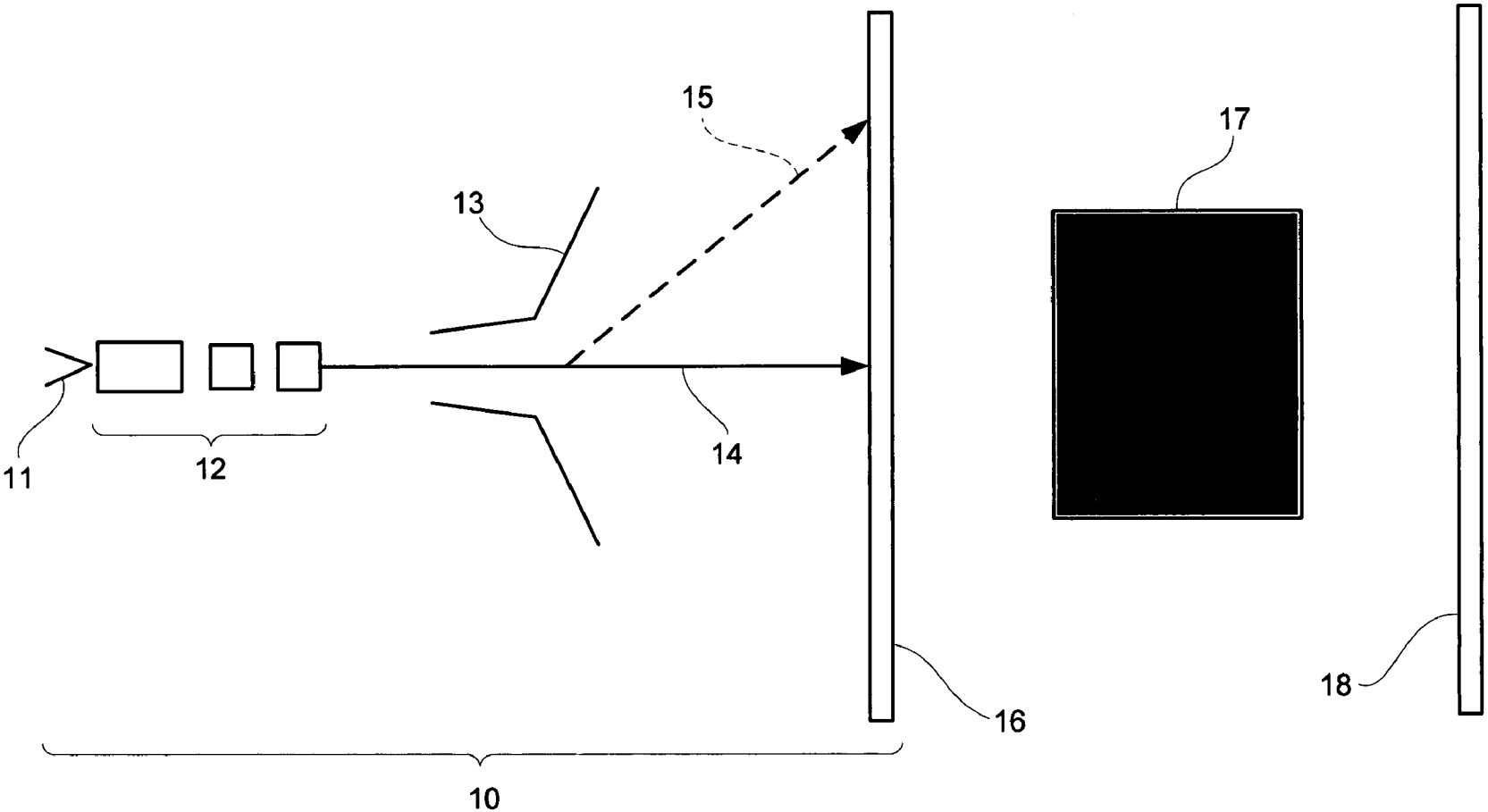
Figure 1 (Prior Art)
FIG. 1 is a schematic view of a conventional example of x-ray generation and detection known in the art.
Figure 2:
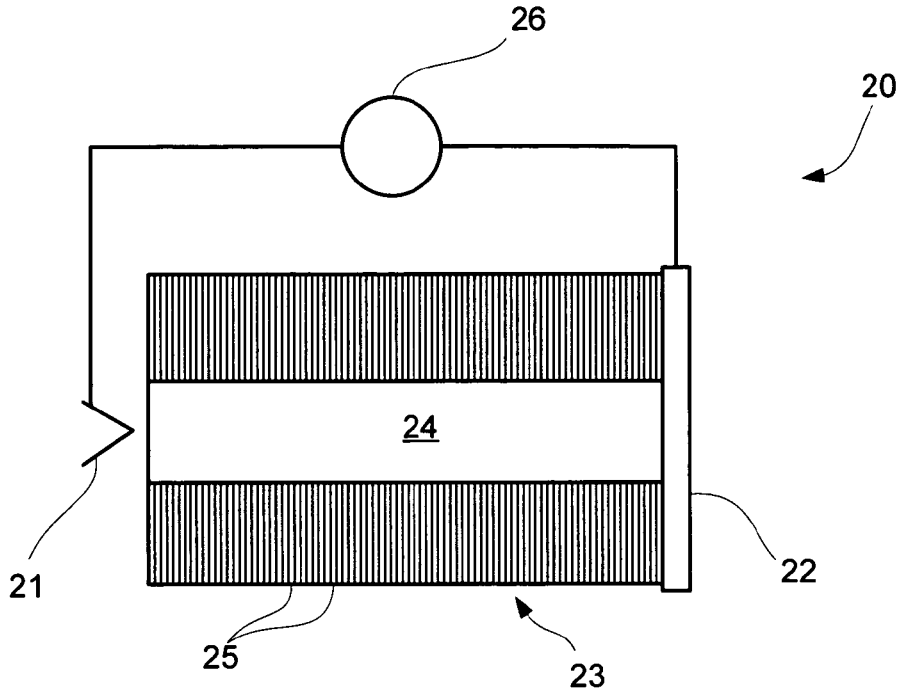
FIG. 2 is a schematic side view of an exemplary embodiment of a unit compact x-ray source of the present invention.

Turning now to the drawings, FIG. 2 shows a preferred embodiment of a single unit x-ray source of the present invention, generally indicated at reference character 20. The x-ray source 20 is shown having an electron source 21 for producing electrons, an x-ray conversion target 22 capable of generating an x-ray beam when incidenced by electrons, an insulator 23 separating the electron source 21 and the x-ray conversion target 22, and a power supply 26 electrically connected to the electron source 21 (cathode) and x-ray conversion target 22 (anode) to produce a voltage potential, i.e. an acceleration gradient, in the drift space 24 therebetween which accelerates electrons toward the x-ray conversion target 22.

The electron source 21 is preferably a heated filament which emits electrons when hot. In the alternative, various types of electron sources which are individually controllable may be utilized, such as for example, thin film ferroelectric emitters, pulsed hybrid diamond field emitters (see for example U.S. Pat. No. 5,723,954, incorporated by reference herein), diamond emitters with an added grid structure, or nanofilament field emitters (see for example U.S. Pat. No. 6,045,678, incorporated by reference herein), etc. And a high-Z target is used, such as for example tungsten, gold, tantalum, etc. for the x-ray conversion target. The electron source is preferably separated from the x-ray conversion target a suitable short distance which is dependent on the particular energy requirements desired for a system. For example, for an x-ray source designed to operate in the megavolt (MeV) range, the separation distance may be chosen in the tens of centimeters, e.g. about 30 cm. And for low energy operation in the kV range (e.g. a few kilovolts to several hundreds of kilovolts), the separation distance can be chosen to be only several millimeters. It is appreciated that the selection of a separation distances is therefore a design parameter which can be determined by a designer of ordinary skill in the art.

Figure 7:
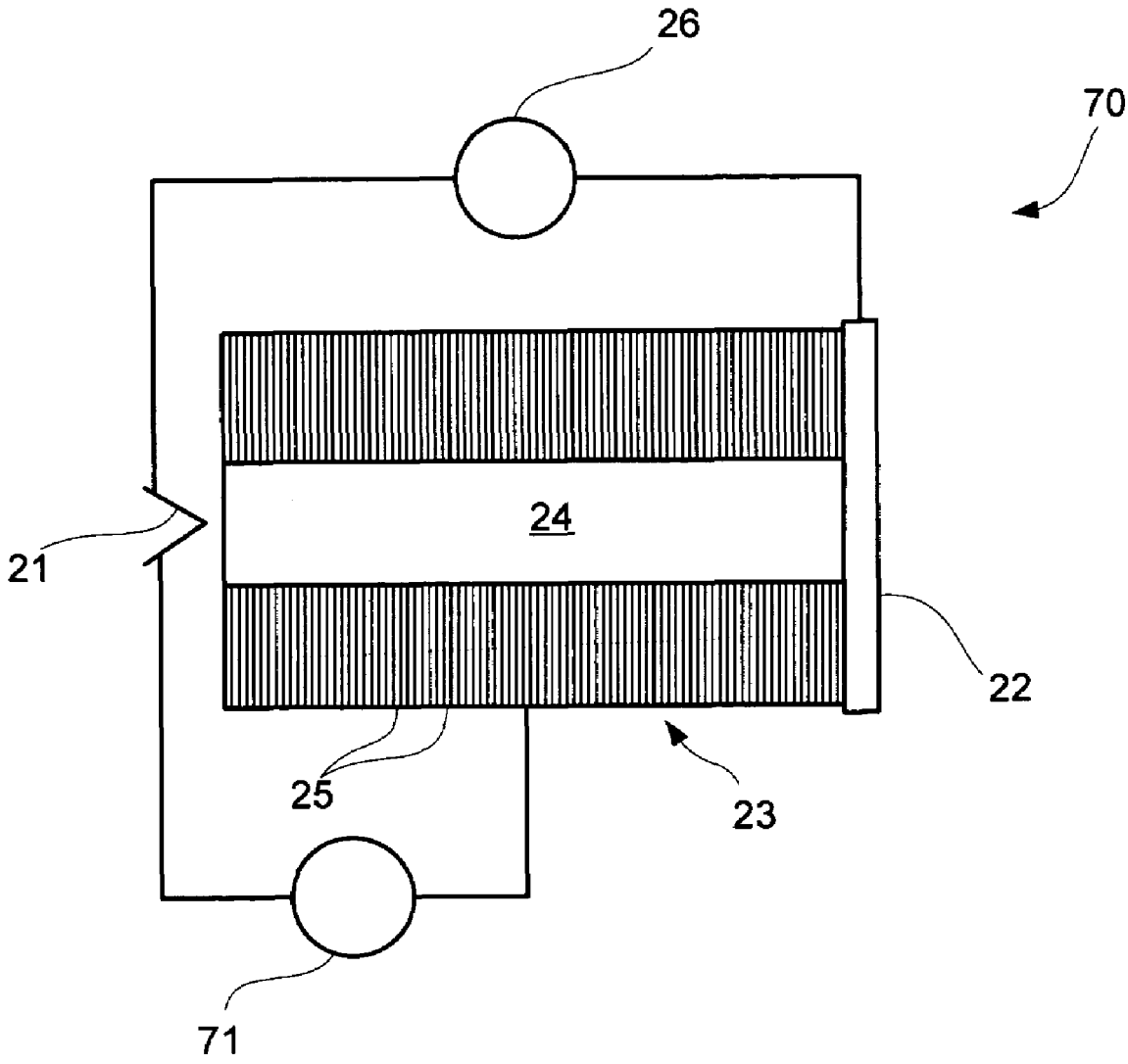
FIG. 7 is a schematic side view of another exemplary embodiment of a unit compact x-ray source of the present invention similar to FIG. 2, and having an intermediate electrode.

The insulator 23 is preferably of a type disclosed in U.S. Pat. No. 6,331,194, incorporated by reference herein, having multiple layers of alternating insulator and conductor layers, e.g. 25 and 26. In particular, the layers are serially arranged in stacked succession to span the drift distance (i.e. separation gap) between the electron source and the conversion target, and preferably formed using the fabrication methods also disclosed in U.S. Pat. No. 6,331,194. Preferably the layers have a thickness less than about 1 mm, with a combined thickness determined by design, as discussed above. Furthermore, the multilayer insulator 23 preferably has a cylindrical configuration with an acceleration channel 24 leading from the electron source 21 to the x-ray conversion target 22, and the alternating layers having a ring-shaped configuration with a preferably circular cross-section. Furthermore, each x-ray source may have at least one intermediate electrode (i.e. anode) positioned between the electron source and the x-ray conversion target, for focusing and controlling an electron beam from the electron source. It is appreciated that the intermediate electrode may also be used to provide a supplemental acceleration voltage across the multilayer insulator structure. FIG. 7 shows a unit compact x-ray source 70, similar to that shown in FIG. 2 with one (or more) of the conductor layers serving as the intermediate electrode (anode) by an electrical connection to a power source 71. In the alternative, the same power source 26 use to connect the x-ray conversion target may also be used to connect to the intermediate electrode by the use of a resistor. It is appreciated that the intermediate electrode may in the alternative comprise a conductor washer (not shown) placed immediately after the electron source and connected to a power source.

Figure 3:
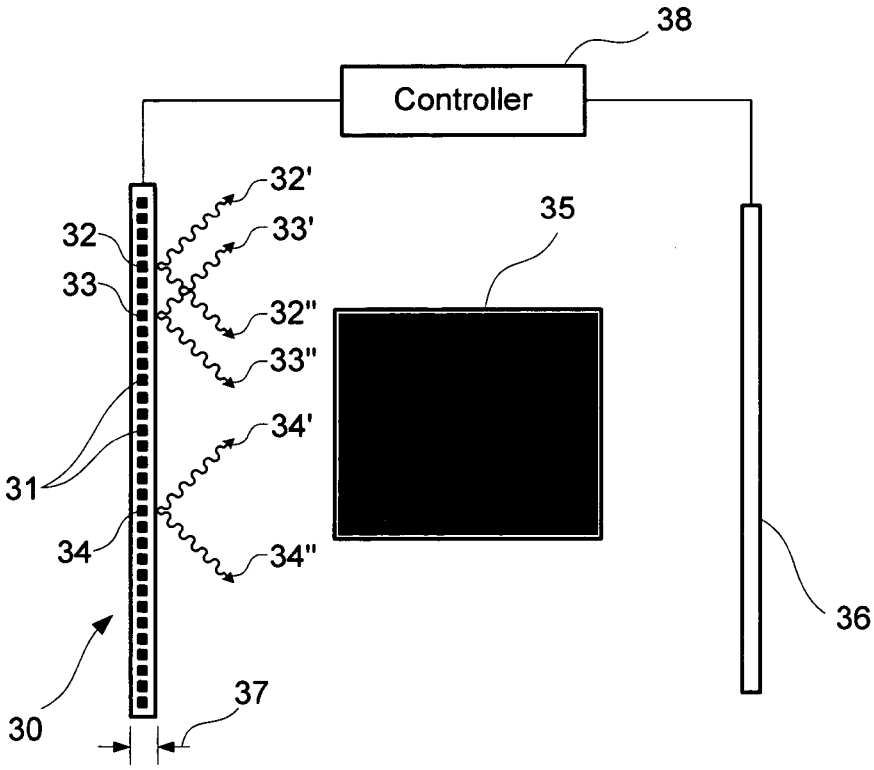
FIG. 3 is a schematic side view of an exemplary planar embodiment of the broad-area x-ray source panel of the present invention used for scanning an object.
Figure 4:
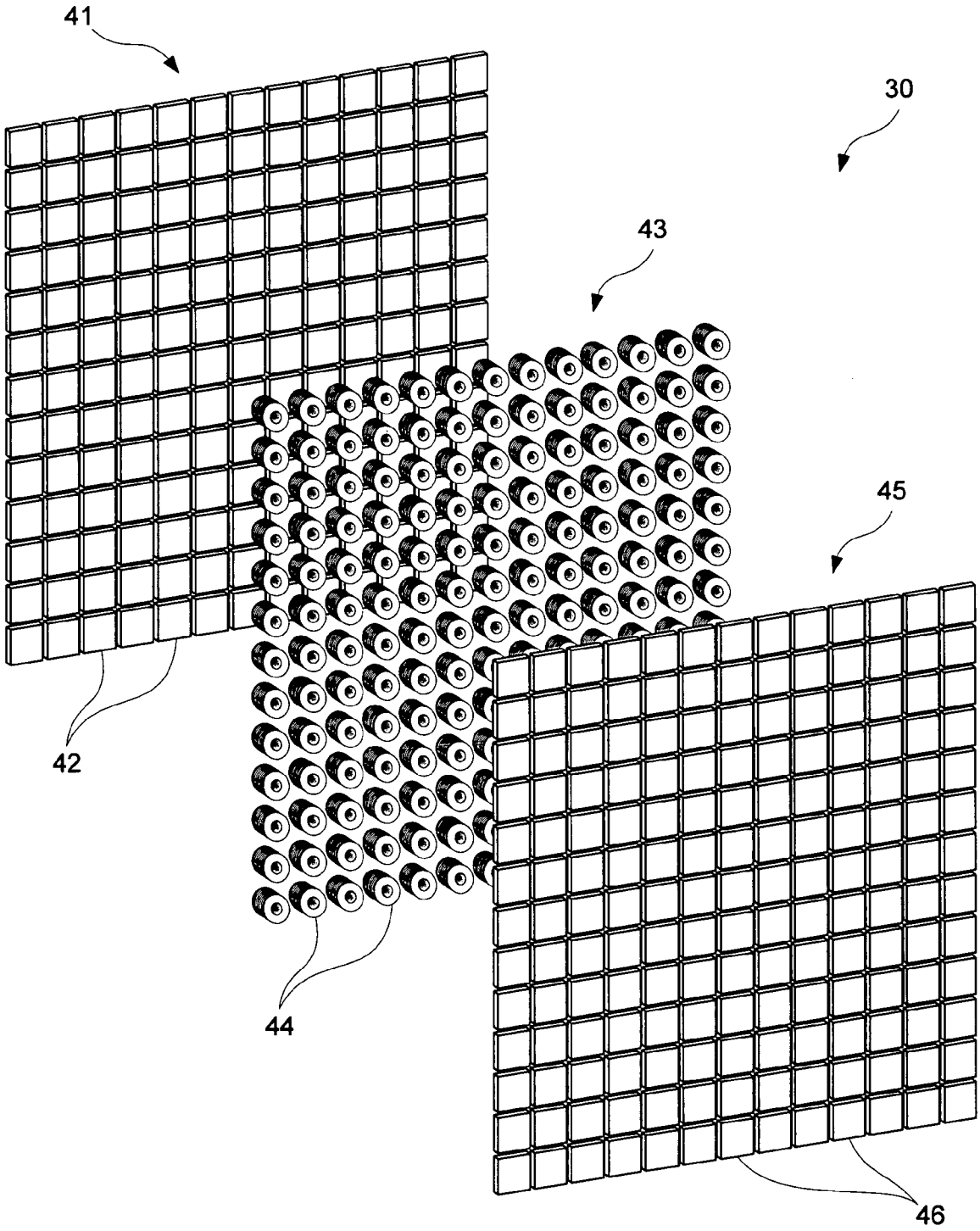
FIG. 4 is an exploded perspective view of a first exemplary planar embodiment of the broad-area x-ray source panel of the present invention.

FIGS. 3 and 4 show a preferred planar embodiment of a compact broad-area x-ray source panel of the present invention, generally indicated at reference character 30, and comprising a plurality of the unit compact x-ray sources 31 arranged to form a planar broad-area array. In particular, FIG. 3 shows a schematic side view of the compact x-ray source panel 30, and FIG. 4 shows an exploded perspective view illustrating the component layers forming the panel 30. The component layers include an electron source component layer 41 having a plurality of unit electron sources 42, a multilayer insulator component layer 43 having a plurality of unit multilayer insulators 44, and an x-ray conversion target component layer 45 having a plurality of unit x-ray conversion targets 46. Each unit x-ray source includes a corresponding component in each of the component layers (one-to-one correspondence), with each independent of other electron sources, insulators, and x-ray conversion targets. Together, the broad-area component layers form a thin and compact broad-area panel having a panel depth 37 which is substantially smaller/thinner than it is tall or wide. A power source (not shown) is electrically connected to each unit x-ray source to activate and produce an acceleration gradient in any one or more of the x-ray sources.

With this arrangement, the plurality of unit x-ray sources 31 may be activated and controlled, such as with controller 38, independent of other unit x-ray sources in the array. For example, each of the unit x-ray sources 32-34 are shown in FIG. 3 independently activated to produce respective x-ray cone beams, represented by rays 32' and 32" for unit x-ray source 32, by rays 33' and 33" for unit x-ray source 33; and by rays 34' and 34" for unit x-ray source 34. In this manner, spatially differentiated x-ray cone beams are generated and directed at a subject, such as block 35, and detected at detector 36. It is appreciated that the unit x-ray sources in the array may be suitably spaced to achieve a desired operational resolution. In a preferred embodiment, for example, the plurality of unit x-ray sources may be so closely spaced to produce a pixelized array comprising a plurality of virtually contiguous x-ray source pixels spanning across the array.

Furthermore, the controller 38 shown in FIG. 3 may be utilized as part of a feedback control system to actively control individual source pixels and selectively generate x-rays to target particular areas of a target subject as necessitated by the application. The controller 38 is shown connected to the detector 36 and the broad-area x-ray source panel 30. The active control may be based on feedback criteria, such as signal to noise ratios at the detector. As such, the compact x-ray source panel of the present invention can be made highly adaptive to specifically target a wide variety of material densities within the object. It is appreciated that active control is enabled in part by the use of individually controllable electron sources, such as the thin film ferroelectric emitters, pulsed hybrid diamond field emitters, diamond emitters with an added grid structure, or nanofilament field emitters, etc. previously discussed. Furthermore, such a feedback control system using the controller 38 is also applicable in a generic sense to control a multi-source array of x-ray sources, having a cathode/anode structure with a conventional insulator intermediately separating the cathode (electron source) from the anode (x-ray conversion target).

Figure 5:
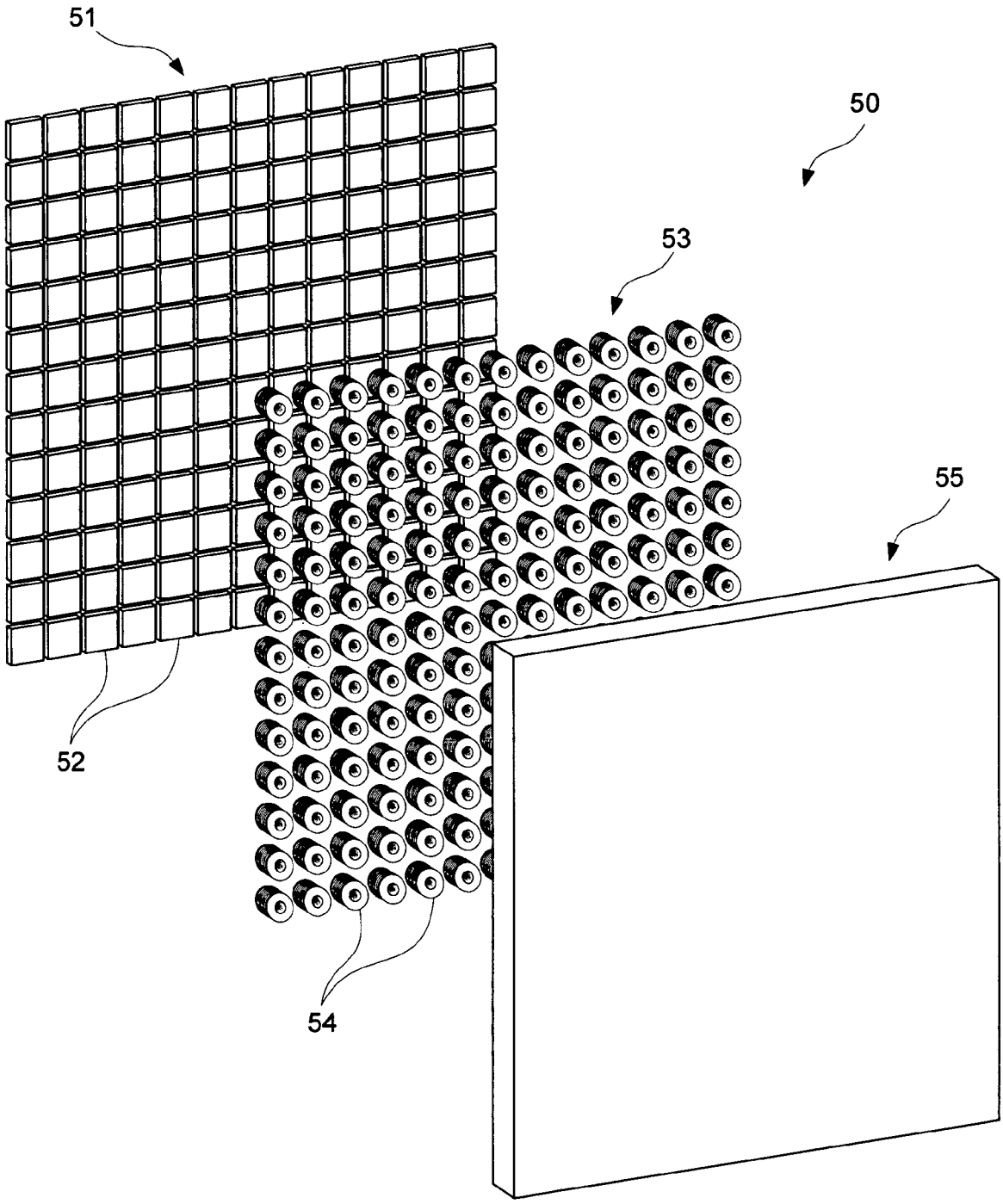
FIG. 5 is an exploded perspective view of a second exemplary planar embodiment of the broad-area x-ray source panel of the present invention.

FIG. 5 shows an alternative preferred embodiment of the present invention, with an electron source component layer 51 having a plurality of unit electron sources 52, a multilayer insulator component layer 53 having a plurality of unit multilayer insulators 54 corresponding in number to the unit electron sources, and a single, monolithic x-ray conversion target 55 which spans across and serves as the target for all electron source/multilayer insulator pairs. In this case, electron beams are independently generated, accelerated, and incidenced on various sections of the bulk x-ray conversion target to produce spatially-differentiated x-ray beams.

Figure 6:
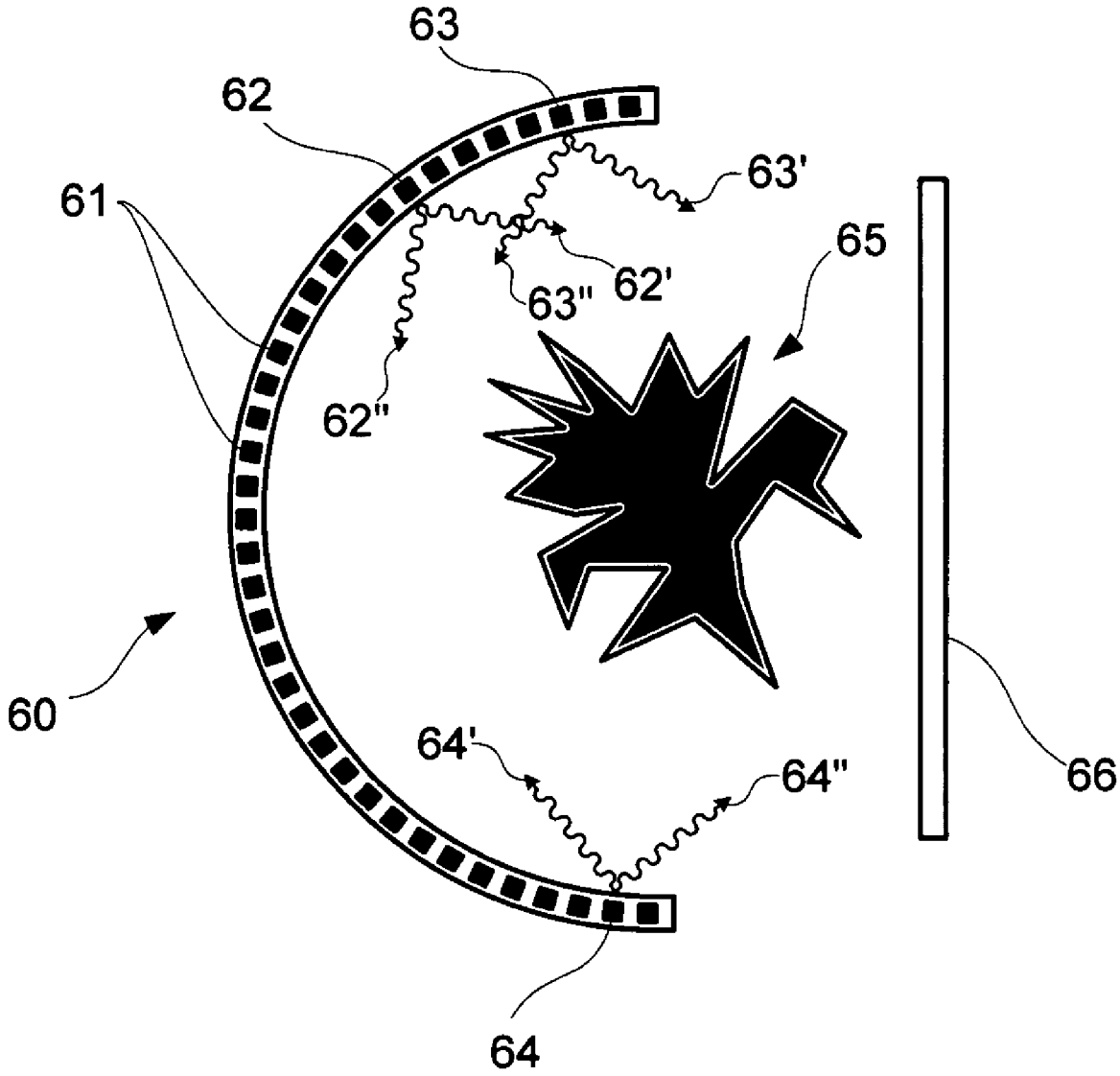
FIG. 6 is a schematic side view of an exemplary curviplanar embodiment of the broad-area x-ray source panel of the present invention.

FIG. 6 shows a curviplanar embodiment of the broad area x-ray source panel of the present invention, generally indicated at reference character 60. It is appreciated that "curviplanar" describes a two-dimensional plane contoured in a curved manner to occupy volumetric space. For example, the curviplanar configuration of panel 60 may be representative of, for example, a cross-section of a hemispheric configuration or trough-like configuration. Similar to the panel 30 in FIG. 3, the panel 60 includes a plurality of unit x-ray sources 61, such as for example unit x-ray sources 62, 63 and 64, which are located at different positions of the curviplanar panel. In particular the various positions of the plurality of unit x-ray sources 61 produce different orientations of the unit x-ray sources such that the x-ray cone beams are directed at different angles toward a target subject 65 for detection by detector 66. See for example x-ray cone beams represented by 62' and 62"; 63' and 63"; and 64' and 64". It is appreciated that the curviplanar configuration may in the alternative also be constructed into a complex shape (not shown) to allow adaptation to a principal object type having an irregular or otherwise arbitrary shape. For example, the curviplanar panel may be particularly sized and configured to receive a patient's entire head, while leaving only the face uncovered.

While the present invention is preferably utilized as a compact x-ray source and panel, it is appreciated that the reduction in scale advantages is not limited only for x-ray generation. The technique of the present invention described above can also be applied using neutrons and positive ions. The ion source can be made, for example, from a surface flashover ion source, or by having a gas discharge behind the accelerating structure and using individual grids to control each pulse to produce the same effect. And for neutron production, the x-ray conversion target discussed above would be replaced with a deuteriated (i.e. $H^2$) of tritiated ($H^3$) target.

While particular operational sequences, materials, temperatures, parameters, and particular embodiments have been described and or illustrated, such are not intended to be limiting. Modifications and changes may become apparent to those skilled in the art, and it is intended that the invention be limited only by the scope of the appended claims.

I claim:

1. A compact x-ray source panel comprising:

an array of x-ray sources, each x-ray source comprising: an electron source; an x-ray conversion target for generating x-rays when incidenced by electrons; and a multilayer insulator having a plurality of alternating insulator and conductor layers separating the electron source from the x-ray conversion target; and a power source operably connected to each x-ray source of the array to produce an accelerating gradient between the electron source and the x-ray conversion target in any one or more of the x-ray sources, for accelerating electrons to toward a corresponding x-ray conversion target.

2. The compact x-ray source panel of claim 1, wherein the x-ray sources are each controllable independent of other x-ray sources.

3. The compact x-ray source panel of claim 1, wherein the multilayer insulator has a cylindrical shape with ring-shaped insulator and conductor layers and an acceleration channel leading from the electron source to the x-ray conversion target.

4. The compact x-ray source panel of claim 1, wherein the insulator layers and conductor layers are each less than 1 mm thick.

5. The compact x-ray source panel of claim 1, wherein the electron source is chosen from the group consisting of: hot filament, field emitter, diamond emitter, hybrid diamond, and nanofilament emitter.

6. The compact x-ray source panel of claim 1,
wherein each x-ray source further comprises at least one intermediate electrode positioned between the electron source and the x-ray conversion target for controlling an electron beam from the electron source.

7. The compact x-ray source panel of claim 1,
wherein the array is a broad-area array of x-ray sources.

8. The compact x-ray source panel of claim 7,
wherein the broad-area array has a planar configuration.

9. The compact x-ray source panel of claim 7,
wherein the broad-area array has a curviplanar configuration.

10. The compact x-ray source panel of claim 9,
wherein the broad-area array has a hemispherical configuration.

11. The compact x-ray source panel of claim 9,
wherein the broad-area array has a trough-shaped configuration.

12. The compact x-ray source panel of claim 7,
wherein the broad-area array is pixelized to comprise a plurality of closely-spaced x-ray source pixels.

13. A compact x-ray source comprising:
an electron source;
an x-ray conversion target;
a multilayer insulator comprising a plurality of alternating insulator and conductor layers which separate the electron source from the x-ray conversion target; and
a power source operably connected to the electron source and the x-ray conversion target to produce an accelerating gradient therebetween, for accelerating electrons toward the x-ray conversion target.

14. The compact x-ray source of claim 13,
wherein the multilayer insulator has a cylindrical shape with ring-shaped insulator and conductor layers and an acceleration channel leading from the electron source to the x-ray conversion target.

15. The compact x-ray source of claim 13,
wherein the insulator layers and conductor layers are each less than 1 mm thick.

16. The compact x-ray source of claim 13,
wherein the electron source is chosen from the group consisting of: hot filament, field emitter, diamond emitter, hybrid diamond, and nanofilament emitter.

17. The compact x-ray source of claim 13,
further comprising at least one intermediate electrode positioned between the electron source and the x-ray conversion target for controlling an electron beam from the electron source.

18. A compact x-ray source panel comprising:
a broad-area array of independently controllable x-ray source pixels, each x-ray source pixel comprising: an electron source for producing electrons; an x-ray conversion target for generating x-rays when incidenced by electrons; and a cylindrical multilayer insulator having a plurality of alternating insulator and conductor ring-shaped layers separating the electron source from the x-ray conversion target, and an acceleration channel communicating therebeween; and
a power source operably connected to each x-ray source pixel of the broad-area array to produce an accelerating gradient in the acceleration channel of any one or more of the x-ray source pixels, for accelerating electrons through the acceleration channel towards a corresponding x-ray conversion target,
wherein the plurality of alternating insulator and conductive layers of the multilayer insulators enable a high resistance to surface flashover in the energy range necessary to produce a sufficiently high accelerating gradient for generating x-rays and with the electron source and x-ray conversion target in close proximity to each other.

19. An x-ray imaging system comprising:
a compact x-ray source panel comprising an array of x-ray sources, each x-ray source comprising: an electron source; an x-ray conversion target for generating x-rays when incidenced by electrons; and an insulator separating the electron source from the x-ray conversion target;
a power source operably connected to each x-ray source of the array to produce an accelerating gradient between the electron source and the x-ray conversion target in any one or more of the x-ray sources, for accelerating electrons toward a corresponding x-ray conversion target;
a detector capable of detecting x-rays generated by said compact x-ray source panel; and
a controller operably connected to receive signals from the detector and control the compact x-ray source panel based upon said signals,
wherein the insulator is a multilayer insulator having a plurality of alternating insulator and conductor layers separating the electron source from the x-ray conversion target.

* * * * *

UNITED STATES PATENT AND TRADEMARK OFFICE

CERTIFICATE OF CORRECTION

PATENT NO. : 7,330,533 B2
APPLICATION NO. : 11/124550
DATED : February 12, 2008
INVENTOR(S) : Stephen E. Sampayan It is certified that error appears in the above-identified patent and that said Letters Patent is hereby corrected as shown below:

On the title page, under Inventors, the first named inventor should read:
Stephen E. Sampayan.

Signed and Sealed this

Third Day of June, 2008

JON W. DUDAS
*Director of the United States Patent and Trademark Office*